US005862555A

United States Patent [19]

Furuhashi

[11] Patent Number: 5,862,555

[45] Date of Patent: Jan. 26, 1999

[54] SYSTEM AND METHOD FOR MANUFACTURING SHOES USING A WOODEN MOLD

[76] Inventor: Masanobu Furuhashi, 6-11-1108, Yushima, 4-chome, Bunkyo-ku Tokyo, Japan

[21] Appl. No.: 790,666

[22] Filed: Jan. 30, 1997

Related U.S. Application Data

[63] Continuation-in-part of Ser. No. 418,099, Apr. 6, 1995, abandoned.

[51] Int. Cl.[6] ..... A43D 9/00; A43D 3/00

[52] U.S. Cl. ..... 12/142 R; 12/133 R; 12/141; 12/128 F

[58] Field of Search ..... 12/141, 142 R, 12/128 R, 133 R, 123, 128 F

[56] References Cited

U.S. PATENT DOCUMENTS

| | | | |
|---|---|---|---|
| 1,365,221 | 1/1921 | Blake . | |
| 1,899,057 | 2/1933 | Pym . | |
| 1,975,763 | 10/1934 | Bindner et al. . | |
| 2,579,896 | 12/1951 | Ashley . | |
| 2,701,887 | 2/1955 | Nolan . | |
| 2,965,982 | 12/1960 | Saffir . | |
| 3,089,166 | 5/1963 | Kamborian . | |
| 3,097,381 | 7/1963 | Kline et al. | 12/141 |
| 3,166,771 | 1/1965 | Kline et al. | 12/141 |
| 3,698,027 | 10/1972 | Schwab et al. . | |
| 4,033,054 | 7/1977 | Fukuoka . | |
| 4,575,889 | 3/1986 | Roseland et al. . | |
| 5,233,768 | 8/1993 | Humphreys . | |

*Primary Examiner*—M. D. Patterson
*Attorney, Agent, or Firm*—Charles E. Bruzga

[57] ABSTRACT

Disclosed is a shoe making system and a method of manufacturing a shoe, in which the work of fastening an inner sole to a wooden mold can be done easily and speedily. In the method, metal plates 23 and 24 having a magnetic absorption property are stuck to an inner sole 21 to form a magnetic absorption portion. On the other hand, magnets 33 and 34 are buried at positions corresponding to the metal plates 23 and 24 in a bottom portion of a wooden mold 31. The metal plates 23 and 24 are attached to the magnets 33 and 34 buried in the wooden mold 31, so that the inner sole 21 is fastened to the wooden mold 31. After the inner sole 21 is fastened to the wooden mold 31, the wooden mold 31 is covered with a shoe upper, and the shoe upper and the inner sole are joined by joins.

17 Claims, 6 Drawing Sheets

SYSTEM AND METHOD FOR MANUFACTURING SHOES USING A WOODEN MOLD

This is a continuation-in-part of application Ser. No. 418,099, filed on Apr. 6, 1995, now abandoned.

FIELD OF THE INVENTION

This invention relates to a system and method for manufacturing shoes using a wooden shoe mold. More particularly, the invention relates to the foregoing system and method for manufacturing a shoe wherein an inner sole of the shoe is fastened to the wooden mold in a detachable manner so as to make a so-called joining process easy.

BACKGROUND OF THE INVENTION

Conventional processes of manufacturing a shoe will be described briefly with reference to FIG. 1. First, in the step (a) a shoe upper 11 is formed by joining genuine leathers or synthetic leathers or the like. In the step (b) an inner sole 13 is attached to a wooden mold 12 by means of nailing and starching and the like.

Subsequently, in the step (c), the wooden mold is covered with the joined shoe upper 11, and a lower fringe portion of the shoe upper 11 is bent to be ready for joining to a peripheral region 13*a* of the inner sole 13. As a result of such work, the lower fringe portion of the shoe upper 11 is bent along the surface of the wooden mold 12. Further, the bent portion 11*a* of the shoe upper 11 is roughened so as to be adhered securely to a bottom sole in a subsequent step described below.

In the subsequent steps, different processes are carried out from each other in a VP manufacturing method and a CP manufacturing method. As an example of the subsequent processes, the CP manufacturing method will now be described. In the step (d) insert members such as a cushioning member 14 for protecting the arch of the foot and a member 15 for bending the front portion of the inner sole 13 are mounted on the inner sole 13. Further, in the step (e) a shoe bottom 16 formed of rubber and leather and the like is manufactured.

In addition, in the step (f) the shoe bottom 16 is adhered to the bent portion of the shoe upper 11 and the inner sole 13 by means of a pressure-applying machine. In general, an insert is placed in a space of the shoes formed by the inner sole 13 and the shoe upper 11 and the insert (not shown) is adhered to the upper surface of the inner sole 13. Thus, the manufacturing processes of the shoe is finished. However, in the conventional manufacturing processes of the shoe, in the step (b) the work to fasten the inner sole 13 to the wooden mold 12 was carried out by nailing or adhering or the like.

When the inner sole 13 is fastened to the wooden mold 12 by nailing, a nail is usually driven into two portions in a toe section and two portions in a heel section of the inner sole 13, respectively; as a result, four portions of the inner sole 13 are required to be fastened by nailing. After fastening of the inner sole 13 to the shoe upper 11 is completed, the four nails driven into the wooden mold 12 must be pulled out; thus, eight processes for pulling out the nails per pair of shoes are required.

In addition, when the inner sole is fastened to the wooden mold at an improper place of the wooden mold which deviates from the normal position, the nails driven into the wooden mold through the inner sole are required to be pulled out and the work for fastening the inner sole to the wooden mold is required to be carried out again after pulling out all nails. Further, there might be caused an accident of injuring due to the failure of the pulling out of the nails.

Also in the adhesion of the inner sole 13 to the wooden mold 12, in the same manner as nailing, the inner sole 13 is required to be adhered to the wooden mold 12 at four portions of the sole 13, namely, at the two portions of the toe section and the two portions of the heel section. After the inner sole 13 is secured to the shoe upper 11, the inner sole 13 is required to be stripped off from the bottom portion of the wooden mold 12, so that eight processes are required.

In addition, shoe makers need an adhering machine of high price that would cost, for example, ten million Yen each.

U.S. Pat. No. 3,166,771 to Kline et al. (Kline '771) discloses a means for magnetically retaining an insole and last in assembled alignment. Its FIG. 6 (not reproduced here) shows a pressure sensitive tape 42 that is to be secured to the inner surface of insole 32. A cooperating magnet 40 is contained in the last bottom 30. The present inventor has discovered drawbacks in the foregoing teaching of Kline '771.

In particular, the present inventor has discovered that the use of a magnetic tape such as tape 42 of Kline '771 requires the tape to be impracticably large in thickness in order to create the required force of attraction to hold the inner sole (or insole) in a predetermined position with respect to a last (or shoe mold). Typically, with commercially available material that can be expected to be formed into the shape of such tape having a width of roughly 20 to 30 millimeters (as can be expected from FIG. 6 of Kline '771), the thickness of the tape reaches as large as roughly 20 to 30 millimeters. Such a thick tape is more appropriately referred to as a strip. Such a thick tape (or strip) poses the major problem of introducing a gap between the inner sole and the mold or last along the periphery thereof, which gap further renders the use of an automatic joining machine impractical. When an automatic joining machine is working to join one part of the inner sole along its periphery, the other portion of the inner sole directly opposite to said portion moves farther away from the bottom surface of the wooden mold, because the thick tape works like a pivot, thereby rendering the joining process impossible.

On the other hand, when the thickness of such tape is made thin enough, for example, less than roughly 0.1 to 0.5 millimeters in thickness which value may be required to prevent a bump in the insole and to make the existence of the tape unnoticeable so as to prevent the shoe from irritating the foot of a person wearing the shoe, the total attractive force provided by such tape is too small to hold the insole or inner sole in the designated position. This is especially so when the whole assembly of insole and last is turned upside down for being subjected to a subsequent process of joining by an automatic machine.

Additionally, the present inventor has discovered that a practical magnetic tape, which must have a relatively large thickness to hold the weight of the inner sole itself, must be removed after the whole manufacturing process is completed so as not to irritate the foot of a person wearing the shoe.

Furthermore, such a thick tape (or strip) poses another drawback for the purpose of providing a simplified system and method for the manufacture of shoes. This occurs when the magnetic attractive means (e.g., strip) is left in a completed shoe. A bump is then introduced in the surface of the inner sole that is directly adjacent the foot of a wearer of the shoe. The wearer's foot is then subjected to irritation caused by the bump.

Additionally, according to the teaching of Kline '771, a cumbersome additional process of attaching the magnetic tape to the insole at each time of production is required. A further problem is the necessity of extra space for storing the magnetic tape. An additional problem is the necessity to carefully align the magnetic tape with the corresponding, magnetically attractive counterparts provided in the bottom surface of the last; this is particularly necessary in view of the great decrease in magnetic force caused by a misalignment.

SUMMARY OF THE INVENTION

One of the objects of the present invention is to avoid the above-mentioned problems in using a magnetic tape as taught by the Kline '771 patent.

A primary object of the present invention is to solve the above-mentioned problems encountered during the step of adhering the inner sole 13 to the wooden mold 12 in the conventional manufacturing methods.

To achieve this object, the inventor of the present invention has made extensive tests, and has found that a combination of a unique wooden mold and a unique inner sole solves the mentioned problems.

The wooden mold and the inner sole of the present invention provides a unique attaching means for attaching the inner sole to the wooden mold easily, and for detaching the inner sole from the wooden mold easily.

A manufacturing method for shoes of the present invention comprises the steps of forming attaching means in a wooden mold and an inner sole of a shoe, fastening the inner sole to a bottom portion of the wooden mold in a detachable manner by means of the attaching means, covering the wooden mold with a shoe upper, and sewing the inner sole to the shoe upper by joins.

In the present invention, the inner sole of the shoe is fastened to the bottom portion of the wooden mold freely detachably by means of attaching means according to the present invention; accordingly, a misarrangement of the inner sole on the wooden mold can be amended easily when the inner sole is fastened to a place which deviates from the normal where the inner sole is to be fastened. Further, there is no fear that products with flaws and stains are manufactured. Since nails are not used when the inner sole is fastened to the wooden mold, any danger that workers are injured due to failing of pulling out the nails does not exist.

In the present invention, a machine for starching and the like is not needed, so that the cost of equipment is reduced. Further, the steps of, e.g., nailing, pulling out of the nails, starching, and ripping off can be omitted in comparison with the nailing and the starching methods of the prior art.

In the work the inner sole is fastened to the wooden mold, the wooden mold is covered with the shoe upper, and the inner sole is joined to the shoe upper by joins. Since strong power to stretch the inner sole in one direction is not required, power for fastening the inner sole to the wooden mold can be produced by means of magnetic absorption (i.e., the ability to be attracted by a magnet), snap fasteners or hook and loop fasteners (mesh room and loop fasteners, self-gripping fasteners, touch and close fasteners) and the like.

In addition, if materials with a magnetic absorption property, such as a steel plate, magnets, snap fasteners, or Magic Tapes or the like, are used as attaching means, the inner sole can be fastened easily to the wooden mold. And, if the shoe is manufactured using the inner sole equipped with magnets serving as attaching means, increased blood circulation due to the magnetic force is expected.

According to the present invention, since the inner sole is fastened to the bottom portion of the wooden mold detachably, the inner sole can be fastened to the wooden mold easily and speedily, and many of the prior art manufacturing steps can be largely omitted.

BRIEF DESCRIPTION OF THE DRAWINGS

For a more complete understanding of the present invention and the advantages thereof, reference is now made to the following description taken in conjunction with the accompanying drawings, in which.

DETAILED DESCRIPTION OF THE PREFERRED EMBODIMENTS

Figure 2:
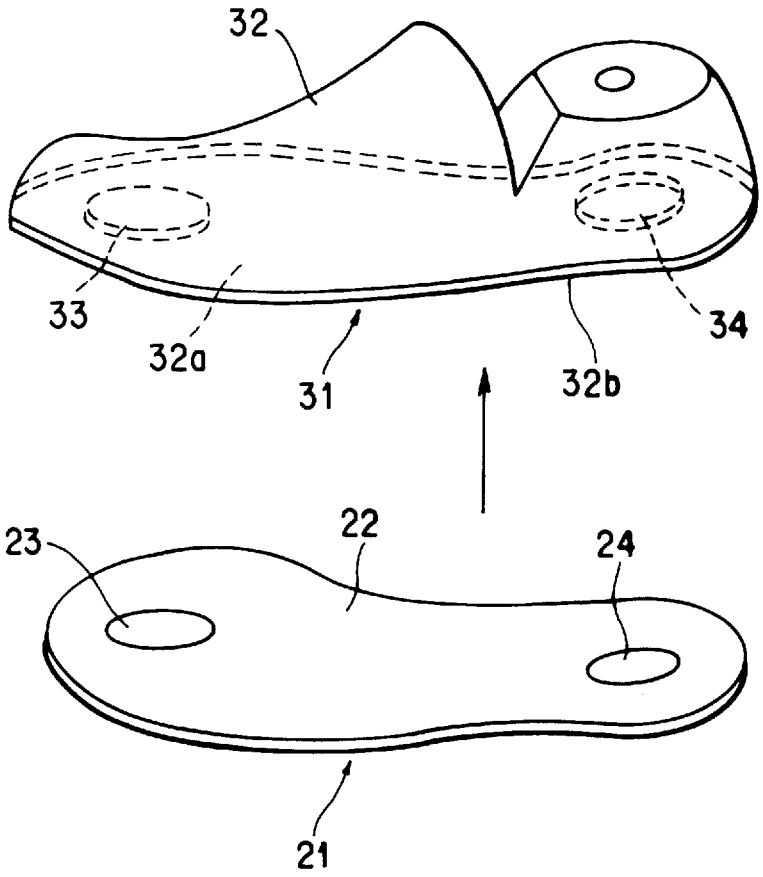
FIG. 2 contains perspective views showing an inner sole and wooden mold of the present invention.

FIG. 2 shows an inner sole of a shoe and a wooden mold of an embodiment according to the present invention.

An inner sole 21 of the shoe of the present invention is formed of a flexible plate of a foot shape as viewed from above. The inner sole 21 may have comparatively thin metal plates 23 and 24 of a magnetic absorption property adhered to the toe section and the heel section thereof. The foregoing metal plates 23 and 24 serve as a magnetic absorption portion of the present invention. By way of example, paper, leather, rubber or vinyl are used for the flexible plate 22. In addition, an iron plate and a stainless steel plate having a magnetic absorption property may be used for the metal plates 23 and 24. Alternatively, a flexible plate containing metal powder and materials which are attracted by a magnetic force and the like may also be used. The flexible plate may be formed of, for example, a synthetic resin or rubber.

Further, the plate 22 of the inner sole 21 may itself be formed of a material exhibiting a magnetic attractive force prepared by adding metal powders having a magnetic attraction property into material that is flexible when cured, so that the whole plate 22 serves as a magnetic attraction section. Synthetic resin or rubber that is flexible when cured may be used, by way of example.

Figure 2A:
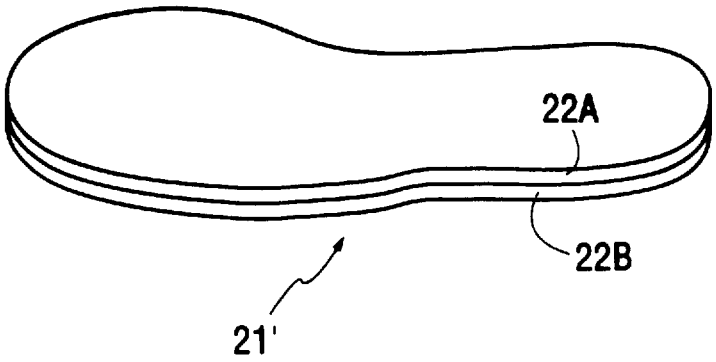
FIG. 2A contains a perspective view of a preferred inner sole that may be used instead of the inner sole shown in FIG. 2.

FIG. 2A shows a preferred construction of inner sole 21', which has the same orientation as inner sole 21 of FIG. 2 with respect to wooden mold 31. In this preferred construction, a flexible plate (or layer) 22A containing magnetic material is permanently attached to another flexible plate 22B, such as paper, leather, rubber or vinyl. Such magnetic material preferably has a magnetic attraction property. Flexible plate 22A may have the same construction as described above in connection with FIG. 2 for plate 22 where it is formed of material exhibiting a magnetic attraction property.

Additionally, flexible plate 22A preferably incorporates magnetic material at substantially the same density throughout its volume. It is preferably of substantially uniform thickness, so that it can be easily obtained. It is preferably no greater than about 2 millimeters in thickness. Its weight is preferably no more than about 30 grams, so that it does not add excessive weight to a shoe. It has been found from testing by the present inventor that a preferable magnetic flux for flexible plate 22A is in the range of from about 400 to about 600 Gauss, and more preferably in the range of from about 400 to about 500 Gauss. This results in a sufficient force of attraction to wooden mold 31 when the whole assembled body is turned upside down for a subsequent process; it also provides ease of aligning the inner sole against the wooden mold 31 by ordinary manual force, as well as ease of removing the wooden mold from the inside of a complete shoe by ordinary manual force.

Preferably, flexible plate 22A is made in the following manner. Initially, ferrite powder to be dispersed and incorporated in a rubber matrix is not magnetized. The reason for this is that, when the powder is magnetized before mixing with rubber, a serious problem is caused wherein the powder itself coagulates into a lump because of the magnetic attractive force inherent in each particle of powder. Therefore, the powder should be non-magnetized at the time of and during the mixing process. The mixture, which is called a compound, is then subjected to a sheet-forming process wherein the compound is placed under a sheet-forming compressive pressure between two rollers positioned directly opposite to each other. Then, after the sheet-forming process, the powder dispersed in the rubber matrix is magnetized by subjecting it to a suitable magnetic field such as provided by a suitable, powerful electric magnet.

The currently available material for such powders is ferrite powders, and it is a common practice to disperse such ferrite powder as much as possible, so that maximum magnetic flux can be obtained. But there is a limit in the amount that can be successfully mixed in a rubber sheet. When an excessive amount of powder is mixed in the rubber matrix, the resulting sheet would not have significant flexibility and, therefore, durability. The maximum amount practical for the purpose of the current invention is about 90% by volume, with 10% being the rubber matrix.

The current available production process comprises a compound containing ferrite powder in a matrix of rubber material being subjected to a compression pressure between two rollers, and subsequently the ferrite in the rubber matrix being magnetized to have a permanent magnetic property. There is no other better method, to the best knowledge of the supplier, for the production of a rubber magnet in a sheet form. Because of this process, there is a certain limit in the thickness of the rubber magnet available in the market wherein the flexibility, durability and magnetic flux necessary for the purpose of the current invention is maintained. This limit is roughly the thickness currently used by the inventor, namely, about 2 mm.

A body 32 of a wooden mold 31 may be formed of a synthetic resin and wood that fit desired sizes and styles of shoes. Note that the term "wooden mold" of the present invention is not limited to a mold made of wood, but it means a mold for manufacturing shoes. In one embodiment of the present invention, the body 32 of the wooden mold 31 has two magnets 33 and 34 buried adjacent to its bottom portion 32*b*. Bottom portion 32*b* comprises a metal plate of iron, for example, adhered to the lower region of body 32 as to cover it entirely. The magnets 33 and 34 are disposed at the positions corresponding to the metal plates 23 and 24 of the inner sole 21, respectively. Specifically, they are preferably disposed at the toe portion and the heel portion of the shoe.

Note that, for example, the whole body 32 of the wooden mold 31 may be formed of material exhibiting magnetic force in itself, so that the whole body 32 exhibits magnetic force. This can be accomplished, for example, by preparing synthetic resin containing magnetic powders for the body 32.

Figure 2B:
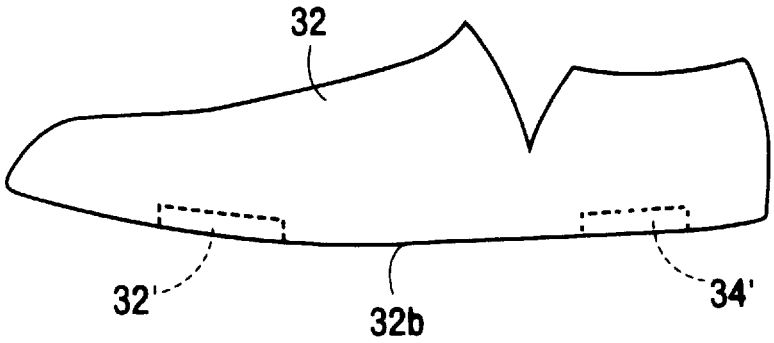
FIG. 2B is a side view of an alternative embodiment of the wooden mold shown in FIG. 2.
Figure 2C:
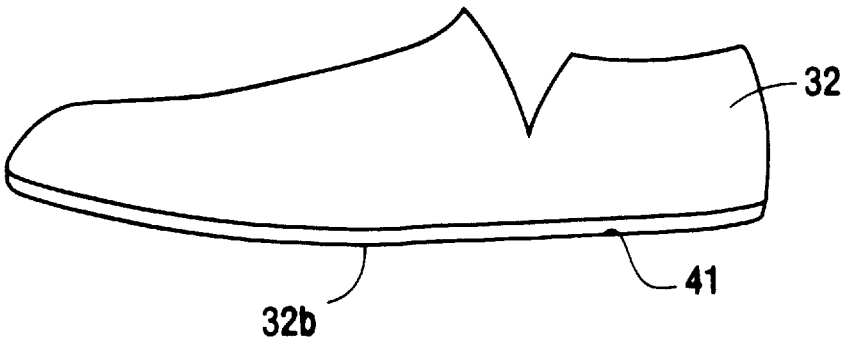
FIG. 2C is a side view of a further, alternative embodiment of the wooden mold shown in FIG. 2.

Further, the number and the positions of the metal plates and the magnets of the wooden mold 31 may be varied suitably according to the objectives. In one such variation, magnets 33 and 34 are omitted, while the mentioned plate of, e.g., iron is retained as shown in FIG. 2. Such plate would then interact with, e.g., the magnetized, flexible plate 22A of the inner sole 21' shown in FIG. 2A. FIG. 2B shows another such variation, in which the bottom portion 32*b* of the body 32 contains metal plates 32' and 34' for interacting with the magnetized, flexible plate 22A of the inner sole 21' (FIG. 2A). In this variation, the metal plates do not need to be magnetized. FIG. 2C shows a still further variation wherein the bottom portion 32*b* of the body 32 is entirely covered by a metal plate 41 for interacting with the magnetized flexible plate 22A of the inner sole 21' (FIG. 2A). In this variation, as in the foregoing variation, the metal plate does not need to be magnetized.

Figure 3:
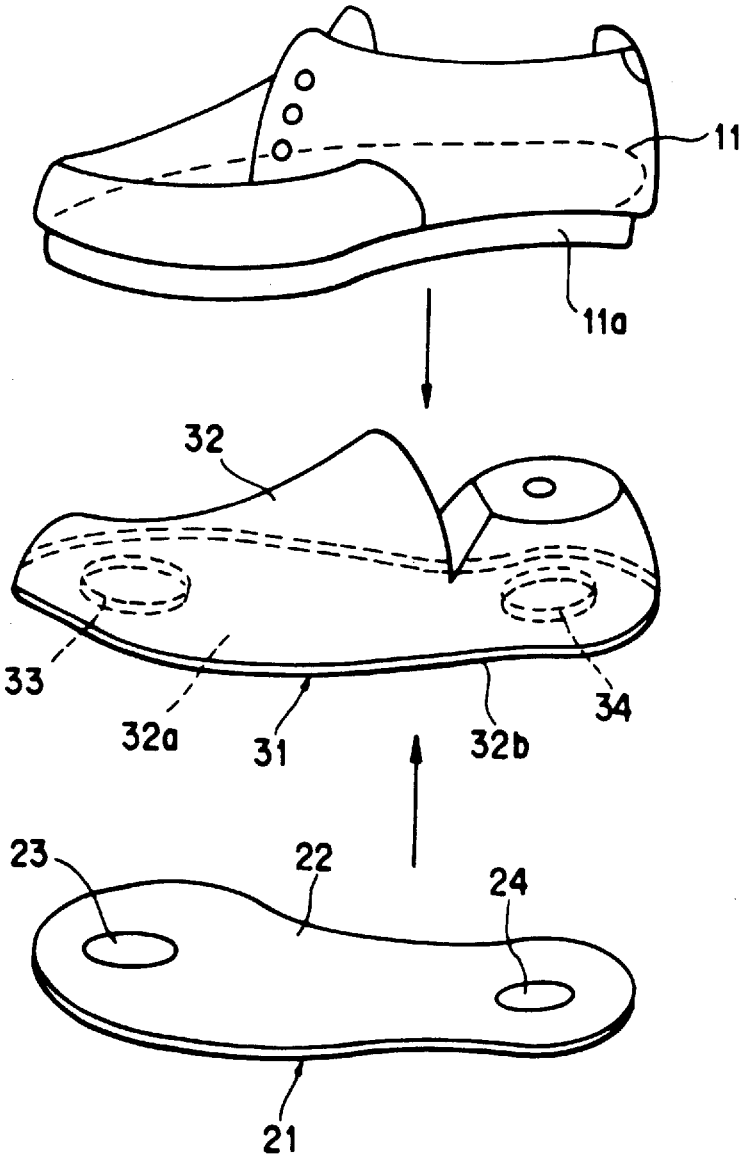
FIG. 3 contains perspective views showing a manufacturing method of the present invention.

In the manufacturing method of the present invention, as shown in FIG. 3, the inner sole 21 is fastened to the bottom portion 32*a* of the wooden mold 31, utilizing the magnetic force between the metal plate 23 and the magnet 33 and the metal plate 24 and the magnet 34. In this situation, the wooden mold 31 is covered with the shoe upper 11, and the lower fringe portion 11*a* of the shoe upper 11 is joined to the outer peripheral portion of the inner sole 21 by joins.

When the lower fringe portion 11*a* of the shoe upper 11 is joined to the outer peripheral portion of the inner sole 21 by joins, since the inner sole 21 may be merely fastened to the wooden mold 31 and localized force is not applied to the inner sole 21, the inner sole 21 can be fastened satisfactorily to the wooden mold 31 by a fastening force utilizing magnetic force. Thus, the inner sole 21 is fastened to the wooden mold 31 utilizing magnetic attraction force, so that an attaching operation of the inner sole 21 to the wooden mold 31 and a detaching operation of the inner sole 21 therefrom can be carried out easily and speedily. Additionally, a positioning error of the inner sole 21 to the wooden mold 31 can be easily adjusted.

Figure 1:
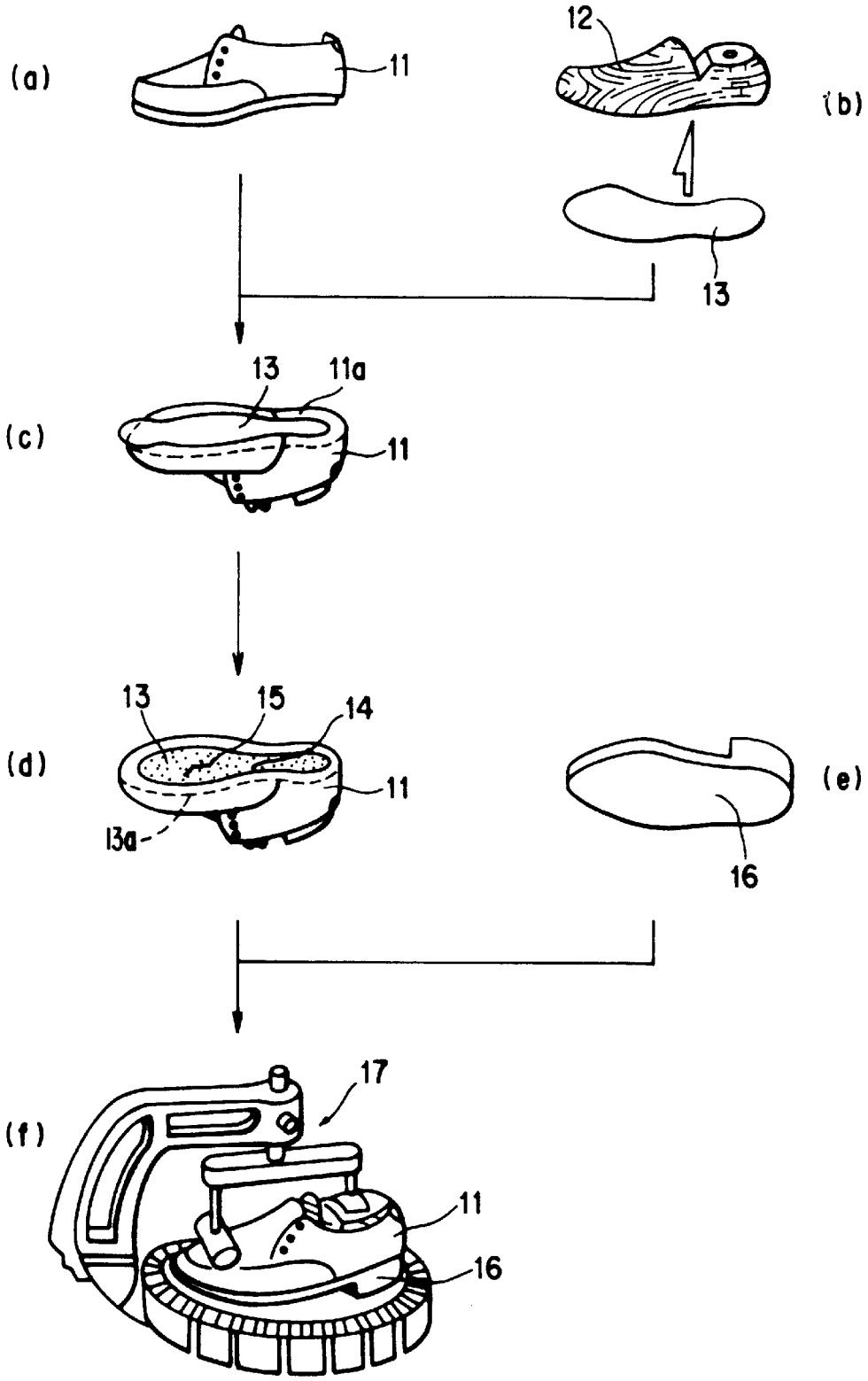
FIG. 1 PRIOR ART
FIG. 1 contains perspective views showing briefly a conventional manufacturing process of a shoe.
Figure 4:
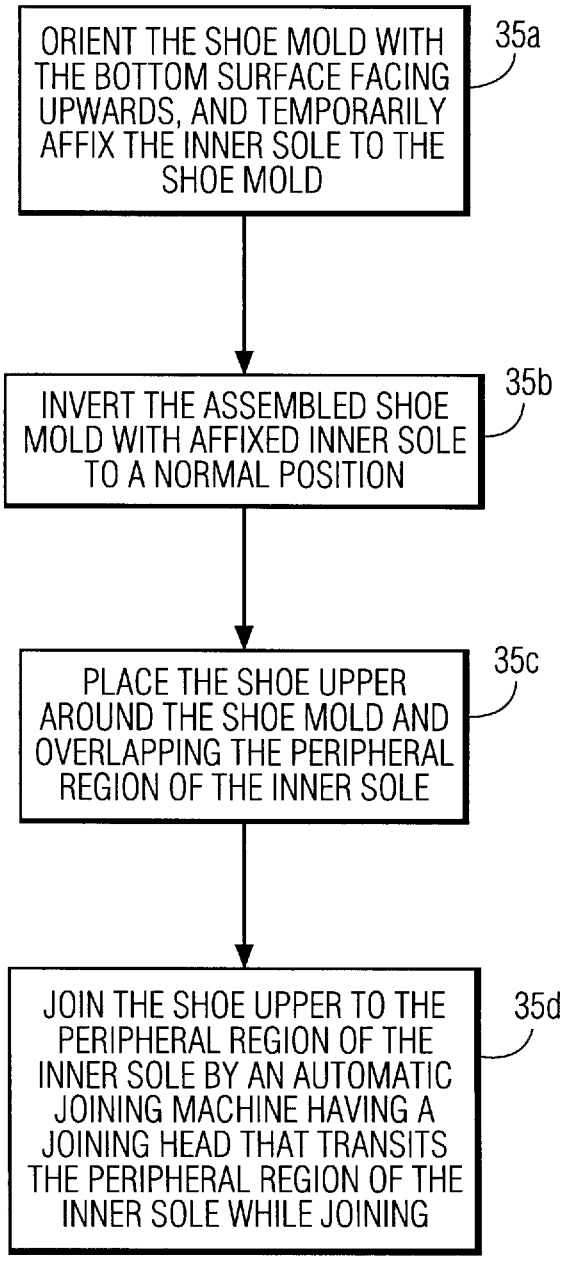
FIG. 4 is a flow process sequence of steps in block diagram form of a preferred method of manufacturing a shoe.

FIG. 4 shows various steps of a preferred sequence for joining a shoe upper to an inner sole. According to step 35*a*, a shoe mold is oriented with its bottom surface facing upwards, and an inner sole is temporarily attached to a shoe mold, e.g., by magnetic attraction as described above. This step corresponds to step (b) in the conventional process of present FIG. 1, but differs by using magnetic force rather than nails or the like. In subsequent step 35*b*, the assembled shoe mold with affixed inner sole is inverted to a normal position. In step 35*c*, a shoe upper is placed around the shoe mold and in overlapping relation to a peripheral region of the inner sole. This generally corresponds to the placement in FIG. 1(*c*) of the shoe upper 11 around the combination of the shoe mold and the peripheral region 13*a* of inner sole 13. In a subsequent step 35*d*, the shoe upper is joined to the peripheral region of the inner sole (e.g., region 13*a* of FIG. 1[*c*]) by an automatic joining machine. Such machine preferably has a joining head that transits the peripheral region of the inner sole while joining.

Note that the metal plates 23 and 24 attached to the inner sole 21 may be ripped off therefrom after the inner sole 21 is joined to the shoe upper by joins. It is a matter of course that the metal plates 23 and 24 may be left between the inner sole 21 and an insert (not shown). If these metal plates 23 and 24 are comparatively thin, an increase in weight of the shoe is small and a bottom portion of the shoe can be reinforced so that rather preferable results can be obtained.

The inner sole 21 having a magnet and a metal plate in a toe and heel section thereof, respectively, and vice-versa, may be used. And the wooden mold having a magnet corresponding to the metal plate formed in the inner sole and a metal plate corresponding to the magnet formed in the inner sole, respectively, may be used.

In the above embodiment, the magnets may be attached to the inner sole and the metal plates may be attached to the wooden mold. Moreover, the magnets may be attached to both of the inner sole and the wooden mold. When the magnets are attached to the inner sole, it can be expected that circulation of the blood of users of the shoes equipped with the above inner sole and the like will be promoted by the magnetic force.

Figure 5:
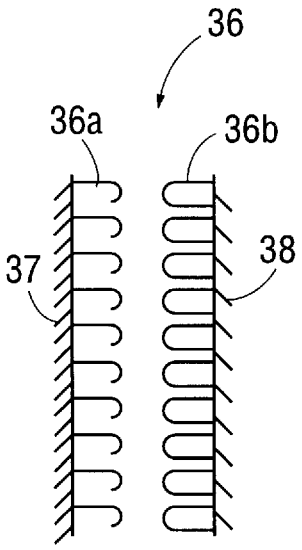
FIG. 5 is a simplified cross-sectional view of a hook and loop fastener that may be used in a first alternative embodiment of the invention.

As an alternative to using material with a magnetic attraction property and material with a magnetic absorption property to achieve the freely detachable attaching means as described above, FIG. 5 shows the use of a hook and loop fastener 36. Hook section 36*a* cooperates with loop section 36*b* to achieve a freely detachable attaching means. Hook section 36*a* is shown mounted upon material 37, which represents either the metal plates 23 and 24 (FIGS. 2 and 3), or the magnets 33 and 34 (FIGS. 2 and 3). Loop section 36*b* is mounted upon material 38, which then represents the other of the metal plates or the magnets.

Figure 6:
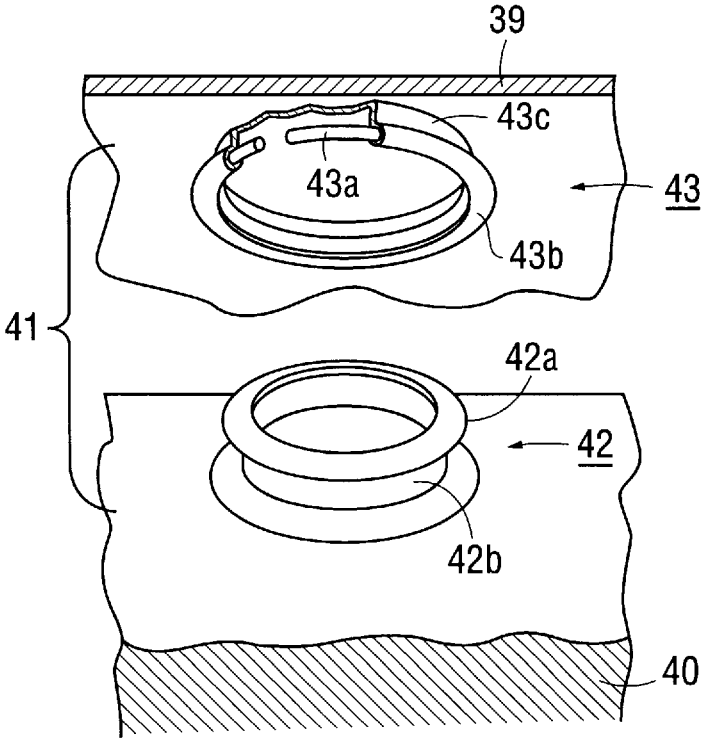
FIG. 6 is a perspective view of a snap fastener that may be used in another embodiment of the invention.

FIG. 6 shows a further alternative to using materials with magnetic properties to achieve a freely detachable attaching means. FIG. 6 shows materials 39 and 40 intended to be held together in a freely detachable manner by a standard snap fastener shown at 41 by a bracket. Materials 39 and 40 may represent an inner sole and a wooden mold, respectively, or vice-versa. Fastener 41 includes a stud member 42, with an engagement portion 42*a* that is enlarged relative to a stem portion 42*b*. A cooperating socket member 43 includes a circular spring 43*a* contained within housing portion 43*b* that is enlarged relative to stem portion 43*c*. Spring 43*a* is non-continuous as revealed by the broken-away portion of socket member 43. In operating snap fastener 41, engagement portion 42*a* of stud member 42 is inserted part way into socket member 43 so that it expands spring 43*a*; it is then inserted further into socket member 43 so that spring 43*a* contracts beneath engagement portion 43*a*. Using one or more snap fasteners in place of metal plate 23 and magnet 33 (FIGS. 2 and 3), and in place of metal plate 24 and magnet 34 (FIGS. 2 and 3), creates a freely detachable connection between materials 39 and 40.

Further, in the above embodiment, attaching means formed of snap fasteners or Magic Tapes may be used for the inner sole and the wooden mold in behalf of the magnetic absorption portion. Although the preferred embodiment of the invention has been described in detail, it should be understood that various changes, substitutions and alterations can be made therein without departing from spirit and scope of the inventions as defined by the appended claims.

What is claimed is:

1. A manufacturing method of a shoe, comprising the steps of:

(a) placing an inner sole adjacent to a shoe mold, wherein a first and a second means are provided in the bottom portion of said shoe mold and in a major side of said inner sole, respectively; said first and second means cooperating to provide a magnetic attractive force between said bottom portion of said shoe mold and said major side of said inner sole; wherein said first means extends substantially entirely over said bottom portion of said shoe mold; and wherein said inner sole further comprises:

(i) a layer of flexible material extending substantially entirely over said major side, and containing throughout its volume magnetic material that forms said second means, and (ii) a further layer of material on which said layer of flexible material is permanently attached; thereby temporarily attaching said inner sole to said shoe mold by a magnetic attractive force;

(b) covering the wooden mold with a shoe upper; and (c) joining a peripheral region of the inner sole to the shoe upper.

2. A manufacturing method according to claim 1, wherein said step of placing an inner sole adjacent to a shoe mold comprises doing so when said shoe mold is oriented with its bottom surface facing upwards.

3. A manufacturing method according to claim 2, further comprising the step of inverting the shoe mold with attached inner sole to a normal position.

4. A manufacturing method according to claim 1, wherein said step of joining comprises joining by an automatic joining machine.

5. A manufacturing method according to claim 4, wherein said step of joining comprises joining by an automatic joining machine having a joining head that transits said peripheral region of said inner sole while joining.

6. A manufacturing method according to claim 1, wherein said layer of flexible material contains said magnetic material at substantially at the same density throughout its volume.

7. A manufacturing method according to claim 1, wherein said layer of flexible material has a thickness no greater than about 2 millimeters.

8. A manufacturing method according to claim 1, wherein said layer of flexible material has a substantially uniform thickness.

9. A manufacturing method according to claim 8, wherein said layer of flexible material further has a thickness no greater than about 2 millimeters.

10. A manufacturing method according to claim 8, wherein said first means comprises a metal plate.

11. A manufacturing method according to claim 1, wherein said layer of flexible material has a magnetic flux of between about 400 and 600 Gauss.

12. A manufacturing method according to claim 1, wherein said layer of flexible material has a weight of no greater than about 30 grams.

13. A manufacturing method according to claim 1, wherein said first means covers an entire bottom portion of said shoe mold.

14. A manufacturing method according to claim 1, wherein said first means is disposed in a toe section and in a heel section of said shoe mold.

15. A manufacturing method according to claim 1, wherein said first means comprises a metal plate in said toe section and a metal plate in said heel section.

16. A manufacturing method according to claim 1, wherein:

(a) said first means comprises material with a magnetic absorption property; and (b) said second means comprises material with a magnetic attraction property.

17. A manufacturing method according to claim 1, wherein said layer of flexible material is positioned in abutting relation to said first means in said shoe mold.

* * * * *